United States Patent [19]

Guntert

[11] Patent Number: 4,493,584

[45] Date of Patent: Jan. 15, 1985

[54] APPARATUS AND PROCESS FOR DOWEL INSERTIONS

[75] Inventor: Ronald M. Guntert, Stockton, Calif.

[73] Assignee: Guntert & Zimmerman Const. Div., Inc., Stockton, Calif.

[21] Appl. No.: 620,532

[22] Filed: Jun. 14, 1984

Related U.S. Application Data

[63] Continuation of Ser. No. 331,864, Dec. 17, 1981, abandoned.

[51] Int. Cl.[3] ..... E01C 23/04

[52] U.S. Cl. ..... 404/74; 404/88; 404/100; 15/256.5

[58] Field of Search ..... 404/72, 87, 100, 114, 404/74, 88, 129; 15/256.5

[56] References Cited

U.S. PATENT DOCUMENTS

| | | | |
|---|---|---|---|
| 2,224,194 | 12/1940 | Mitchell | 404/88 |
| 2,295,947 | 9/1942 | Heltzel | 404/88 |
| 2,389,773 | 11/1945 | Golden | 404/88 |
| 2,596,206 | 5/1952 | Carnes | 404/100 |
| 3,068,766 | 12/1962 | Houck | 404/88 |
| 3,098,413 | 7/1963 | Buntert et al. | 404/87 |
| 3,334,559 | 8/1967 | Taylor | 404/100 X |
| 3,443,495 | 5/1969 | Heltzel | 404/100 |
| 3,841,777 | 10/1974 | Domenighetti | 404/114 X |
| 3,853,444 | 12/1974 | Jones | 404/100 X |

FOREIGN PATENT DOCUMENTS

| | | | |
|---|---|---|---|
| 1390491 | 4/1975 | United Kingdom | 404/88 |

*Primary Examiner*—Stephen J. Novosad
*Assistant Examiner*—Beverly E. Hjorth
*Attorney, Agent, or Firm*—Townsend and Townsend

[57] ABSTRACT

A dowel insertion apparatus and process is disclosed for the insertion of a plurality of joining dowels in freshly placed concrete slabs. Each dowel is grasped each by an individual inserter. Typically the inserter is mounted from a carrier and includes paired tangs having female dowel receiving ends of arcuate configuration at the lower portion thereof which female arcuate ends precisely mate to and receive the dowels. These tangs are connected at a depth above maximum concrete penetration by an electromagnet. A vibrator is attached to the inserter to liquefy the concrete. A dowel storage bin with distributing conveyor enables a row of inserters mounted to a carrier to distribute a plurality of dowels between two intended joints simultaneously, the dowels being evenly distributed the width of any contraction joint.

16 Claims, 12 Drawing Figures

APPARATUS AND PROCESS FOR DOWEL INSERTIONS

This is a continuation of Ser. No. 331,864, filed Dec. 17, 1981, now abandoned.

This invention involves a method and apparatus for placing steel dowels in cementatious materials within the intended transverse weakened plane contraction joints relatively immediately after concrete is accurately placed by paving machines. By placing the dowels after the concrete is accurately placed by paving machines, the dowels can be accurately located within the material. There is provided a dependable, continuous, rapid, accurate, and economic method to distribute and place steel dowels in the area of the intended transverse weakened plane contraction joints between concrete panels without production delays.

STATEMENT OF THE PROBLEM

In construction materials used for roadways and runways, placement of contraction joints is required. These contraction joints permit the concrete to shrink and crack upon cure preventing it from randomly cracking into irregular panels. Additionally and during the life of such roadway or runway panels, working occurs due to thermal expansion and contraction and if not adequately supported by base flexure due to the passage of traveling loads, such as trucks and planes.

Typically, cementatious slabs on being placed or shortly thereafter are provided with contraction joints. These joints are formed, subsequently to placing, formed or sawn to a depth that is in the order of one-third the thickness of the panel. The remaining portion of vertical depth of the panel crack in sympathy with the formed contraction joint along irregular boundaries that can be best described as mortise joints.

When the weakened plane is induced at proper intervals at or shortly thereafter the time of placing, cracks are irregular and the two edges are by their "mortised" nature supportive of each other to the degree that as the length between joints increases, the width of the crack increases. As the crack width increases, the supportive mortised effect diminishes.

The juncture between panels at contraction joints for lack of support has been the source of problems leading to even the destruction of the joints. The panels at the mortise joints splay and abrade upon working one with respect to another, depositing material from the vertical abraded surface of the panel within the lower portion of joint itself. With the percipitated material accumulated at the bottom of the joints of the panels, expansion and contraction is restricted at bottom of joint. As a result, ends of panels tend to raise up at the joints.

Moreover, where there is any type of irregularity of ground support or uneven loading—as the passing of a heavy wheel—the panels work to differing elevations at their edges. To support and alleviate these effects, dowels placed in horizontal alignment in the direction of expansion and contraction are used between panels.

The dowels must be accurately placed. The dowels must have sufficient depth so that the concrete does not break out in the vicinity of the dowel placement. Moreover, they must be precisely longitudinally, transversely and horizontally aligned. This permits the panels to work towards and away from each other along the dowels without development of detrimental force and at the same time prevents the panels from changing their elevation relative to one another during such towards and away movement.

Imprecise dowel placement can be disastrous. Specifically, where dowels are aligned in a fashion that is other than horizontal and generally other than normal to the plane of the contraction joint, and more particularly where the dowels are skewed randomly out of a normal to the plane of the contraction joint, the expansion-contraction of the adjacent concrete panels eventually causes panel destruction at joint. Specifically, side-by-side dowels skewed at random angles destroy the concrete panels from the edges commencing with the panel portion adjacent the dowel. Systematic panel destruction of the edges and loss of dowel support results.

SUMMARY OF THE PRIOR ART

Heretofore, one practice for the placement of dowels has included placing dowels on "chairs" in the path of devices such as slip form or conventional paver. Specifically, the "chairs" rest on the ground and at an upper and elevated position hold and maintain dowels in alignment. Concrete is placed over the "chairs" with the weakened plane joint being subsequently formed or sawn over the longitudinal outer limit of the dowels. Numerous disadvantages are present.

Dowels mounted on chairs are time consuming to place. Moreover, the chairs are expensive; they must be sturdy enough to withstand concrete being placed and poured over them without having undue deflections so as to randomly skew the dowels. Additionally, the chairs are permanently lost. They become embedded in the slab but do not add to the structural value.

The placement of dowels in freshly placed concrete at intended location of joints of abutted concrete panels has been attempted. However, the attempts heretofore have been unsuccessful for at least four reasons.

First, the necessary controlled level of the machines on which the apparatus for the insertion of dowels is mounted have been displaced upwardly. This upward displacement has occurred upon forced movement of the dowels down in and into the non-fluid resisting previously placed concrete. There results unacceptably irregular pavement surfaces.

Moveover, such inserters have left openings behind their passage; the finished concrete has holes or openings, often concealed, in and under the surface where the concrete has had the dowel inserted. Additionally, such openings may have either been filled with latence (a froth)—in which case they vastly weaken the resulting concrete panel in the critical stress area of the joint and the dowel—or have inhomogeneously been filled with grout.

This filling of the panel with froth or grout overlying the dowels can be understood. Machines which place dowels have heretofore left imprints in the freshly poured cementatious material. These imprints generally are indentations corresponding to the size and configuration of the dowel and the apparatus for placing the dowel. Such machines have relied thereafter upon finishing beams to cover over and finish out these imprintations directly over the placed dowels. This reliance has been misplaced primarily because filling in of such imprintations generally occurs with grout. Further heavy working of the irregular surfaces by finishing beam tends to displace the alignment of the dowels.

Finishing beams in passing over poured and cured concrete depress large concrete particles (such as aggregate and the like) in their paths of travel and accumulates the concrete fines (a mixture of sand, small gravels and cement known as grout) in their path of travel. This accumulated grout typically precedes a finishing beam and readily fills the indentations caused by the placement of dowels.

Unfortunately grout does not have the strength and is not homogeneous with concrete including the aggregate. Therefore, grout-filled imprintations directly over dowels constitute points of weakness.

This problem compounds itself. Specifically, the area of joinder or working of a dowel to a concrete panel constitutes a relatively high stress area of a concrete panel. To have a grout-filled area of weakened strength immediately overlying such a dowel can constitute a serious structural weakness.

Dowels placed by vibrating arms mechanically gripping the dowels are known. Heretofore, such machines for the automatic insertion of dowels have had numerous disadvantages.

First, their heads for mechanically gripping the dowels have been of large dimension. These heads in extending into the concrete leave in their wake large displaced areas and depressions, which areas and depressions become subsequently filled with grout.

Secondly, the dowels lacking sufficient vibration liquefication are literally forced into the non-fluid cementatious material. Upon such forcing, reactive forces cause displacement of the platform from which they are placed. Reference to line and grade is lost. Where the platform from which placement occurs is a paving machine, detrimental disturbance of the surface regularity can result.

Additionally, the dowels themselves being forced into the concrete do not necessarily bond to the concrete in a homogeneous fashion. As the concrete is physically displaced in the path of the dowel (instead of being in effect liquefied), dowel joining to the concrete panel as required is uncertain.

One of the major shortcomings of machines that have attempted to place dowels into concrete has been the failure to provide shock buffering capacity (vibration isolation). This shock buffering capacity has been lacking between the vibrating inserter and the machine or platform on which it is supported and actuated and the material placed. Where vibrational isolation or insulation is not present, vibrational energy is needlessly and sometimes destructively communicated from the inserter to the platform from which dowel placement occurs or to the material being placed. Moreover, the vibrational energy is not confined to the inserter. Indeed, in concrete mixtures of low slump, placement of dowels by machine has only occurred with moderate success.

The reader will recognize that identifying the problem related to the prior art is ofttimes the equivalent of invention. It will be understood that in recognizing the failure of the prior art to adequately isolate vibration, I claim invention over the prior art.

SUMMARY OF THE INVENTION

A dowel insertion apparatus and process is disclosed for the insertion of a plurality of joining dowels in freshly placed concrete at center line of intended weakened plane joint. Each dowel is grasped, each by an individual inserter. Typically the inserter is mounted on a carrier. A vibrator is non-magnetically attached to inserter below the isolators to communicate vibrational energy to the inserter, this vibrator being chosen to have sufficient vibrational energy to adequately liquefy the concrete. This inserter includes paired magnetic tangs having half female dowel receiving ends of arcuate configuration at the lower portion thereof which female arcuate ends precisely in full contact mate to and receive the dowels. These tangs are connected at a depth above maximum concrete penetration by an electromagnet. Dowel insertion includes positioning the dowels and the paired magnetic steel tangs of each inserter over a magnetic steel dowel. Such grasping occurs with vibration off, turning on the magnet and grasping a dowel in a precise fit to the half round female arcuate surfaces of the dowel. Thereafter, with vibration off, the dowels and inserters are positioned over the intended joint in freshly placed concrete. When a timer indicates insertion is to occur, the vibrators turn on and the vibrating inserter is lowered. Upon insertion into the concrete, the inserter and firmly grasped dowel vibrate and liquefy the adjacent concrete in their downward passage. This allows full depth penetration of the dowel in precise vertical and horizontal alignment relative to the referenced line and grade of the dowel insertion apparatus. At full depth, the vibrator turns off and the dowel instantly becomes embedded in the freshly placed (now solid) concrete as the lack of vibration solidifies the concrete relative to the dowel. Thereafter with vibration off, the inserter is withdrawn a short distance clear of the dowel, the vibration is recommenced with the vibrating tangs fluidizing the concrete and filling any resultant voids. Vibration of the inserter continues clear of the concrete causing it to shed adhering concrete. Tangs are cleaned particularly in the vicinity of the female arcuate surfaces by passage of the tangs over a wire brush. Upon the vibrating withdrawal of the inserters downwardly protruding tangs, the finished surface of the concrete is left substantially undisturbed.

A dowel storage bin with distributing conveyor enables a row of inserters mounted to a carrier to pick up the required dowels between two intended panels simultaneously, the dowels being evenly distributed over the width of any joint. A carrier for handling a group of correspondingly distributed inserters enables the disclosed mechanism to be operated off of a moving platform referenced to line and grade, such as a slip form paver, or on an independently mounted and moved frame. By synchronizing carrier movement so that speed relative to the ground is not present, dowel insertion along a joint after placing can occur without disruption of paver or platform movement.

OBJECTS, FEATURES AND ADVANTAGES

An object of this invention is to disclose an apparatus for the insertion of steel dowels in freshly placed cementatious slab at intended contraction joint locations. According to this aspect of the invention, an inserter is disclosed including paired tangs extending downwardly with a lower extremity including a rounded half female arcuate surface for extending over and onto and precisely joining to a dowel. The tangs are interconnected by a magnet. Preferably, the tangs consist of a non-magnetic steel above the magnets and below the vibrators. This upper non-magnetic portion of the inserters prevents magnetizing the bearings of the vibrator. The lower magnetic portion of the inserters causes energizing of the magnet when the tangs are in contact with a dowel to complete a magnetic circuit to firmly grasping the dowel. The inserter has a vibrator for generating vibrational energy sufficient to liquefy the concrete into which the tangs and dowel are inserted. At an area between the inserter and any platform from which it is operated, a resilient mounting is placed. This mounting serves to limit the required accuracy of cylinder stroke and permits good firm contact of the half female portion of tangs with dowel to insure good magnetic connection.

The magnet is isolated in its magnetic circuit from the vibrator. An advantage of isolating the magnetic circuit away from the vibrator is that the vibrator bearings do not have a magnetic field communicated to them. Consequently, magnetic particles drawn to the bearings are avoided. Bearing races do not suffer the high and abrading wear rate of bearings with magnetic particles drawn thereto.

An advantage of the disclosed rod-inserter and vibrator unit is that precise alignment and placement of dowels can occur. The dowels are located accurately with respect to grade and line by manipulation of the inserter.

Yet another advantage of the inserter is that the prior art practice of placement of the dowels with a "chair" is avoided. A time consuming and expensive placement of "chairs" before panel curing is avoided.

An additional object of this invention is to disclose a dowel inserter which can be modified to meet varying specifications for the placement of dowels. According to this aspect of the invention, the concrete penetrating tangs are welded to the inserters to fit the specifications of each job. Specifically, they are given a length so that required elevational insertion from line and grade is accommodated. Moreover, individual inserters are given variable side to side spacing so that the specified side to side spacing between dowels is likewise accommodated. In short, simple machine modification before a job enables high productivity once paving is commenced.

Yet another advantage of the inserter of my invention is that inserters can be individually removed, serviced and replaced. Consequently, repair of inserters damaged at their vibrators or magnets is possible. Moreover, downtime of the dowel inserting machine is maintained at a minimum.

Yet another object of this invention is to disclose a process for dowel placement using the disclosed inserter. According to this aspect of the invention, the inserter is first placed over and onto a dowel and the magnet energized. The resulting closed magnetic circuit including the dowel causes the dowel to be firmly grasped. The inserter and dowel are then placed over a designated and freshly poured joint area between two concrete panels. Immediately prior to dowel insertion, the vibrator is turned on. The concrete is liquefied in the path of the dowel and inserter as the dowel is inserted and passes to its desired full depth. Once the dowel is at depth, the vibrator and magnet are turned off. Concrete solidifies about the dowel immediately embedding the dowel. Thereafter the inserter is retracted a small distance before the vibrator is reactivated. When the vibrator is reactivated, only the concrete in the immediate vicinity of the inserter tangs is fluidized. Consequently, upon retraction of the inserter, any holes which form about the penetration of the inserters are refilled. The surface of the panel is generally restored.

A further advantage is that the magnetic circuit used for holding the dowels gives the inserter and dowels a small profile. Insertion may easily occur.

An advantage of the disclosed process is that immediately prior to lowering of the dowels, their positioning relative to the joint area between two adjacent concrete panels can be visually checked. Precise dowel placement results.

A further advantage of the disclosed process is that the concrete is fluidized during dowel insertion. Consequently, reactive forces on the inserters are minimized. Where the machine is mounted to slip form a conventional paving apparatus, undue displacement of the paver and corresponding deformation of the slab does not occur. Where the inserter is mounted to an independent frame unit, movement of the frame from supporting tracks or wheels does not occur.

Yet another advantage of the disclosed process is that during the insertion of the dowel, the concrete placed is not segregating into grout and aggregate components or otherwise appreciably disturbed. Consequently, the rod joined to the panel is fully capable of accommodating the designed contraction and contraction. Areas of panel weakness do not exist on, in, above or about the dowel.

Still another advantage of the disclosed process is that once the rod is at the desired depth and the vibration stopped, instant solidification of the concrete about the rod occurs. Consequently, the rod is immediately embedded into the surrounding concrete. Retraction of the placing tangs from the rod can occur with a minimum of disturbance.

Yet a further advantage of the disclosed process is that after the tangs are free of the dowels but before they are completely withdrawn from the concrete, the vibration is reactivated. This vibration fluidizes the concrete immediate the tangs but does not affect the concrete immediate the dowel. Consequently, the concrete tends to flow and replace any void created by the inserting forks. Vibration is not stopped until the inserting forks are free of the freshly poured panel.

A further advantage of the disclosed process is that the concrete is maintained in a homogeneous panel in and around the inserted dowel. The disclosed vibrating and fluidizing process does not classify or segregate constituents of the concrete. It does not leave void in the concrete. Moreover, the accumulation of grout above the inserted dowel does not occur.

A further advantage of the apparatus and process herein disclosed is that dowel insertion occurs into freshly poured concrete panel and not ahead or in the path of concrete paving machinery. In many instances, the front or the sides of concrete paving machinery become otherwise occupied as large quantities of concrete to service automated pavers must be brought in in these areas. Indeed, some roadways are built in areas of restricted access where only the front portion of the paver is accessible. Here, however, dowels are not required to be placed in front of the paver. Instead dowels are inserted to the rear of the machine. Production convenience in dowel insertion is achieved.

A further obJect of this invention is to provide for the insertion of dowels in mass across a joint between two intended concrete panels. According to this aspect of the invention, a magazine loaded with rods is discharged to a chain conveyor having a plurality of stations thereacross. The conveyor receives and spaces dowels in anticipation of the dowels being picked up by correspondingly spaced inserters. When the conveyor has precisely positioned the dowels, the inserters, correspondingly precisely positioned, grasp the rod through contact and thereafter activation of the inserter magnets.

An advantage of this aspect of the invention is that the disclosed apparatus can be made the width of poured concrete panels. By variation of the spacing on the conveyor and corresponding variation of the spacing between inserters, varying rod dimensions and spacing can be accommodating.

The reader will remember that I have utilized resilient mountings for the inserters of this invention. As a side benefit of the resilient inserters that I utilize, I now am able to convey dowels into precise position for pickup by inserters having the same corresponding precise position. Vibrational energy is not communicated to my conveyor. Consequently, dowels on my inserters do not "walk" or vibrate out of position; they remain precisely positioned so that remote handling is possible.

Yet another object of this invention is to disclose a hydraulically actuated carriage for operating a plurality of inserters. According to this aspect of the invention, the carriage operates during rod insertion to maintain a stationary position over an intended joint between two panels. At the same time, the carriage is operating from a moving frame referenced to line and grade, such as a slip form for the placement of concrete. There results a placement of dowels across the area of an contraction joint from a moving platform without interruption of the progress of work.

An advantage of this aspect of the invention is that production of a slip form paver is not interrupted. Periodic stopping and starting of the paver are not required.

A further advantage of this apparatus is that the disclosed apparatus can be mounted relative to or independent of a paver. For example, it can be mounted on its own separate frame which may either be intermittently positioned for dowel placement or continuously moved so long as reference to grade and line is maintained.

Other objects, features and advantage of this invention will become more apparent after referring to the following drawings and attached specifications in which.

Figure 1:
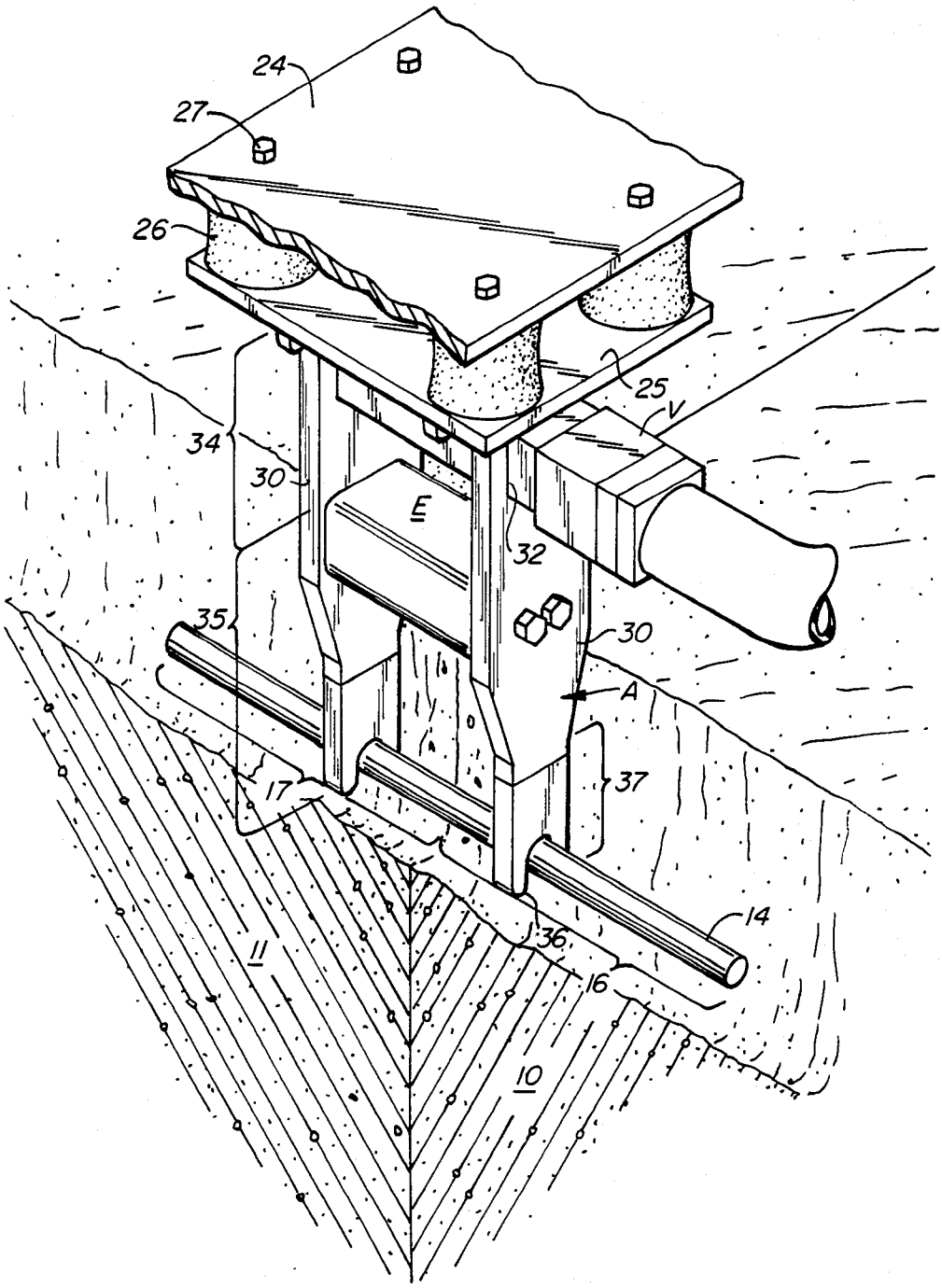
FIG. 1 is a perspective view of a single inserter according to this invention.

Referring to FIG. 1, rod inserter A of this invention is shown in perspective overlying concrete slabs 10 and 11 with dowel 14 extending across a contraction joint area between the panels. The reader will realize that the contraction joint has not been yet placed. The contraction joint is only schematically shown so that placement of the dowel in the panel across the joint is fully understood.

Typically, one portion 16 of the dowel 14 is greased, painted or otherwise coated. The remaining portion 17 of the dowel 14 is not coated. Curing of the concrete causes portions 17 of dowel to key to slab 10. The coated portion of the dowel 11 is free to work in contraction and contraction when either curing contraction or thermal expansion.

It is important that dowel 14 be normal to the plane of the contraction joint between the slabs 10, 11. Thus toward and away contraction can be accommodated without the destruction of the panels from the edges as previously described.

It will be realized that should a group of dowels 14 be randomly skewed, working of the two slabs 10 and 11 would change the spacial distances between the slabs at the points of dowel joinder. Slabs 10 and 11 would chip and splay at their edges resulting in reduced joint life.

In the portion of the description that follows, the construction of a single dowel inserter will first be set forth. Thereafter, a conveyor for dispersing a group of rods will be described. Then the construction of group inserters for grasping and thereafter inserting the dowels between freshly poured panels will be set forth. Finally and with reference to a cartoon series of drawings, the discrete steps in the dowel inserting process will be set forth.

Dowel Inserter

A typical dowel inserter A includes inserter support beam 24 dependingly supporting individual inserter support plate 25. Typically four rubber shock isolaters 26 concentrically mounted to bolts 27 support plate 25 from plate 24. Isolaters 26 insulate the vibration of vibrator V from the support 24 so that the vibrational energy of the hydraulic vibrator can be usefully confined to the vicinity of the inserter. As hereinbefore set forth, the failure to install insulators has resulted in failure of the prior art devices.

Support plate 25 has conventionally joined two tangs 30. Tangs 30 at the upper end thereof define a square or round aperture 32 into which vibrator V is received. Aperture 32 has mounted thereto clamps such that vibrator V is firmly captured therein so the vibrational energy is readily transferred to the tangs 30.

An electromagnet E is mounted between tangs 30. Fabrication and installation of this electromagnet is not trivial.

First, the electromagnet is fabricated so there is no relative movement between any of the parts of the electromagnet and the two tangs 30 to which it is braced and cross connected. As is apparent, the vibrator V will literally destroy the electromagnet E in case any portion of the magnet comes free from the entire assembly and begins to vibrate.

Secondly, the electromagnet in the vicinity of its fastening to the respective tang 30 is securely mounted. Relative movement between the electromagnet E and its point of mounting not only causes failure of the magnet to communicate its magnetic field to the tangs 30, but additionally also effectively destroys the magnet.

With reference to FIG. 1, each of the arms 30 has a magnetic portion 35 and non-magnetic portion 35. Non-magnetic portion 35 can be seen to terminate just above magnet E. This non-magnetic portion 34 prevents the field of the electromagnetic from being communicated upwardly to the inserter support plate 25. Magnetic portion 35 of the tang enables the field of the magnet to be communicated down to and towards the bottom portion of the tangs 35. When a magnetic circuit is completed between the lower portions of the two tangs, as by a dowel contacting the tangs, the magnetic circuit is completed and the dowel is firmly held and grasped in place.

The isolation of the magnetic field from electromagnet E from portion 34 of the inserter has an additional advantage. Typically, the vibrator V comprises an eccentrically weighted shaft mounted to bearings. The shaft is in turn driven by a motor, the motor here being shown as hydraulic. Electric motors can be used as well.

Should the magnetic field from the electromagnet E be accumulated to the vibrator, reduced vibrator life can result. I have found that any metallic particles present in or near the vibrator will be drawn to and accumulated within the vibrator bearings. Such accumulation causes rapid abrading wear of the vibrator. There results a vastly reduced vibrator life.

It will be noted that the lower end of each of the tangs 30 is provided with a rounded section 36. Rounded section 36 is configured to extend up and over a dowel. This half-round aperture is flaired so that when the inserter A comes down over a dowel 14, a gathering of the dowel to a central position occurs.

The half-rounded or arcuate portion of the tangs must be configured to precisely fit over the dowel 14. Anything less than a precise fit will not allow a stable connection and the vibrational or magnetic energy of the vibrator V or magnet M to be communicated to the dowel 14. Vibrators are preferably run at a speed (energy output) sufficient to liquefy the concrete.

Additionally, the tangs at lower portion 37 must be of sufficient length to permit dowel penetration into the slab. Consequently, the lower portion of the arms 37 are usually tailored to the specific construction being undertaken by the dowel inserter. In actual practice, they are welded in place, used for a particular job, and thereafter cut off and replaced. As those skilled in the art are aware, tailoring of the machine for a particular job is desirable.

Additionally, the lower portion of the arms 37 is provided with a relatively constant cross section. This lower portion 38 has the greatest penetration into the slab.

Having set forth the construction of the inserter, attention will now be directed to the conveyor mechanism for disposing bars for pick-up and a support for a multitude of inserters. The views of FIGS. 2 and 3 will be used.

Conveyor

Figure 2:
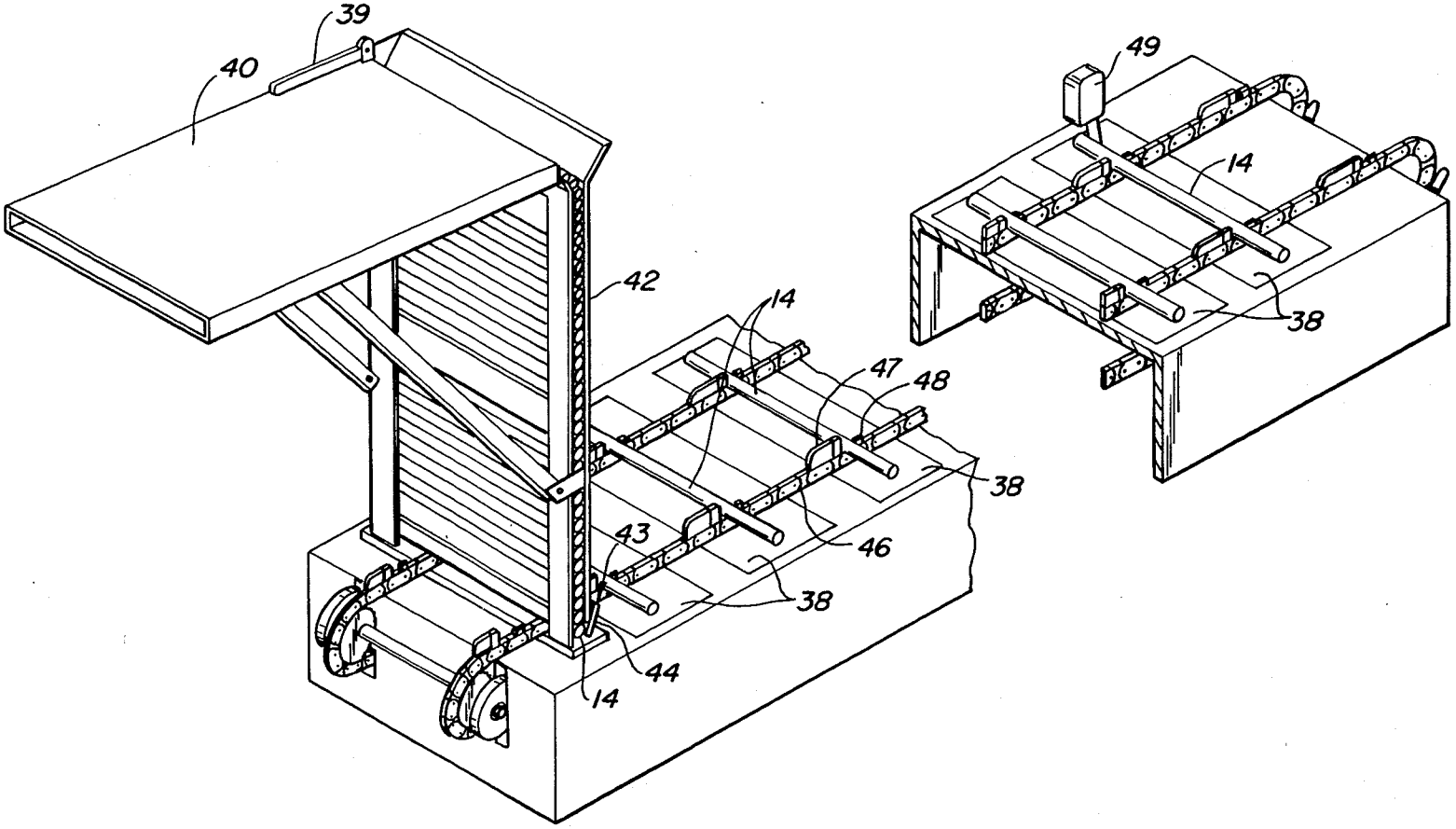
FIG. 2 is a perspective view of a conveyor for conveying rods into positions for grasping by a plurality of inserters, the conveyor here being shown connected to a magazine.

Referring to FIG. 2, a magazine of cylindrical rods is illustrated having an angularly sloping section 40 extending to a vertical section 42. As can be seen, the rods are confined in single file down to a feed mechanism 43.

Sloping section 41 typically has rods 14 placed therein sufficient to constitute a complete joinder across a concrete panel. Once the rods 14 are loaded in section 40 they are released by a release handle 39. Upon release at the release handle 39, they travel en masse down to vertical section 42. At vertical section 42 they are held until released by the conveyor mechanism.

Feed mechanism 43 includes a spring loaded arm 44 maintaining each of the individual rods 14 over paired traveling endless chain belts 46. Endless chain belts have pawls 47 and keeper bars 48 sequentially fastened thereto.

In operation, keeper bars 48 pass under a rod 14 at the bottom of vertical section 42. Pawls 47 dislodge rod 14 and pivot the spring 44 out of the way. Typically, chains 46 continue movement until a limit switch 49 detects the presence of a dowel at the end of the conveyed path. The endless chains then stop.

Figure 3:
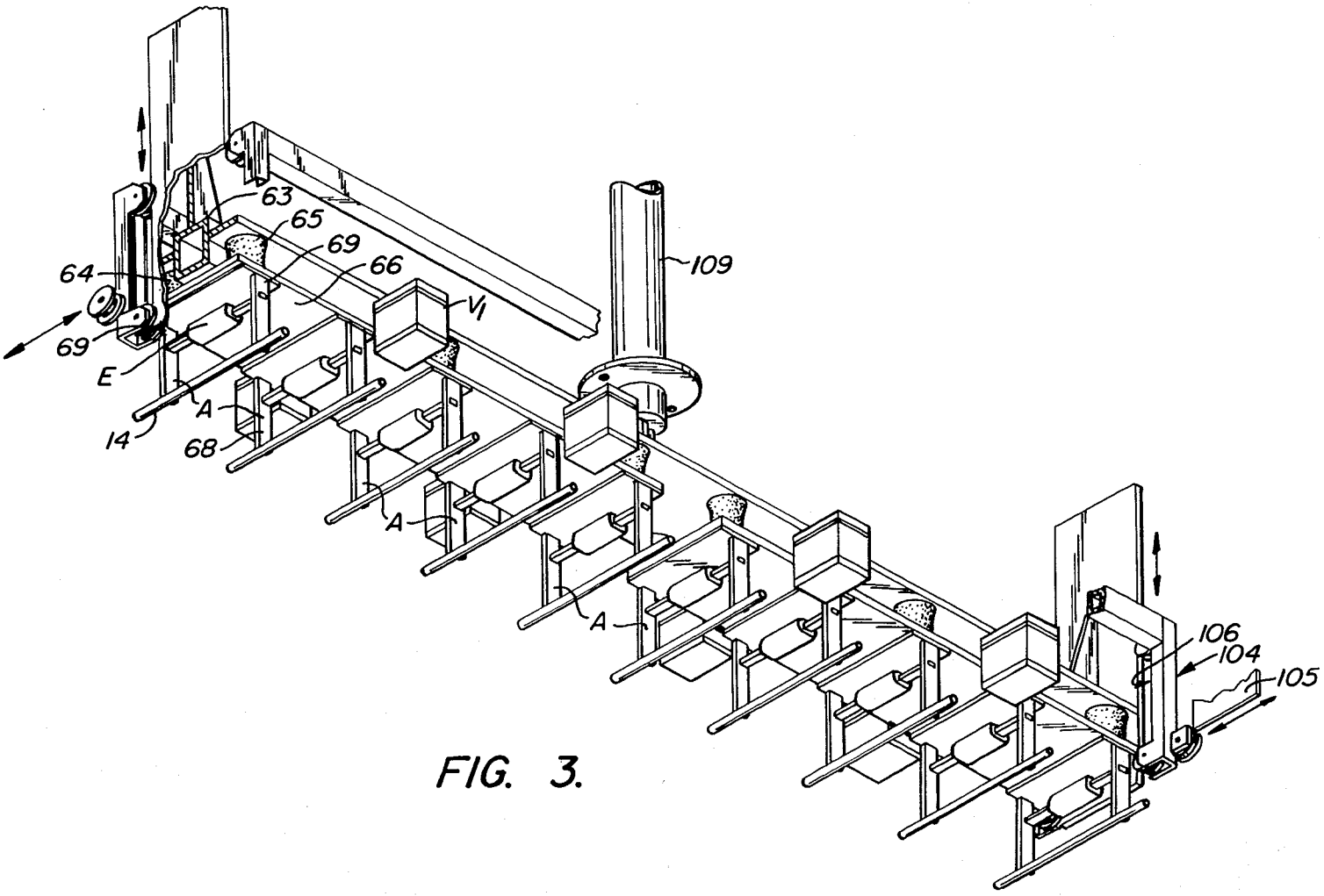
FIG. 3 is a perspective view of a matrix of inserters mounted for picking up and thereafter inserting a group of rods.

It will be therefore be seen that the dowels are distributed at even spatial intervals fully along the length of the conveyor. It is in this disposition that they are picked up by a group of inserters A as illustrated in FIG. 3.

Figure 5A:
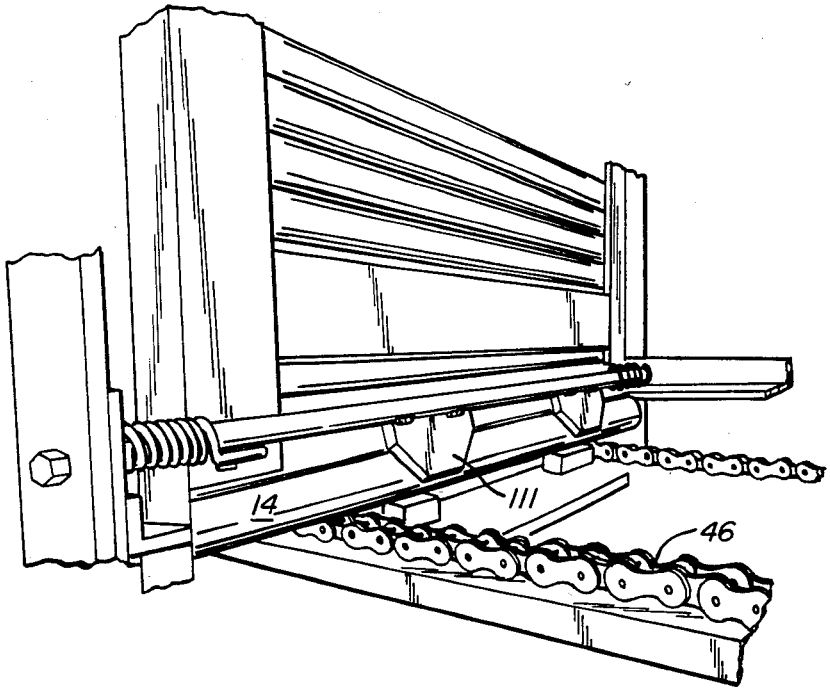
FIG. 5A is a perspective view of the rod release mechanism of this invention at the bottom of the conveyor.
Figure 5B:
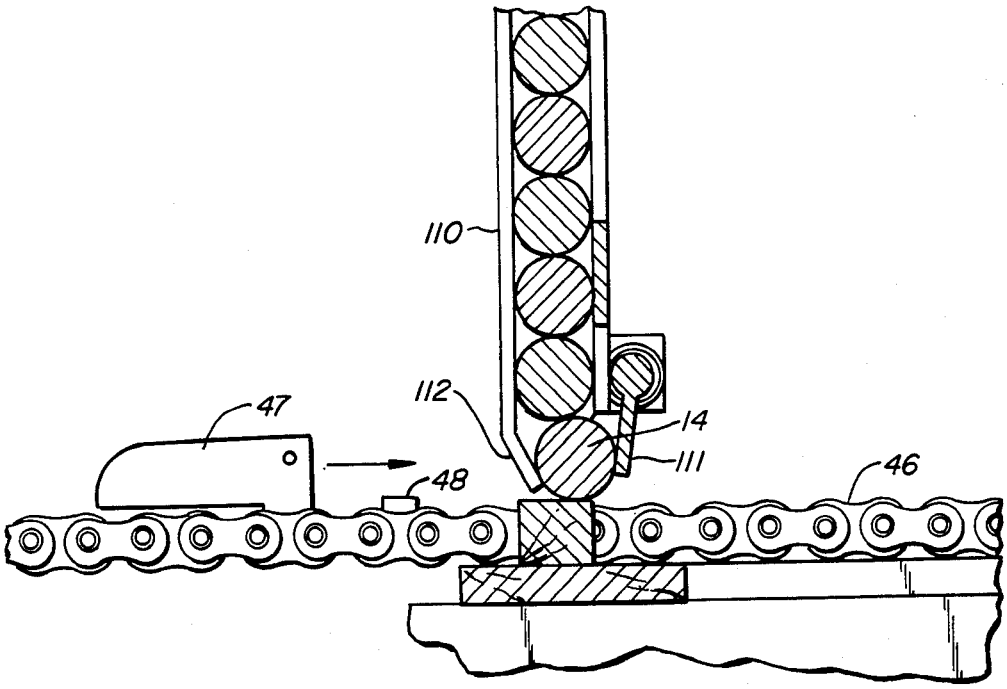
FIGS. 5B, 5C and 5D are a cartoon series in side elevation section illustrating the release of rods according to this invention.

Referring to FIGS. 5A and 5B, the process of insertion and dispensing of the individual rods 14 to the conveyor may be understood. A vertical channel 110 conveys the rods single file to a dispenser. A block 111 holds the dispensed rods free and clear of the passing chain 46, the pawl 47 and the keeper bar 48. As can be seen, the bottommost bar 14 is biased to and toward the direction of travel of the chain with a spring-loaded retainer bar 111 stopping the respective bars from falling out in an unlimited number on the surface of the chain 46. It will be noted that vertical channel 110 is provided with a forwardly angled backpiece 112.

Figure 5C:
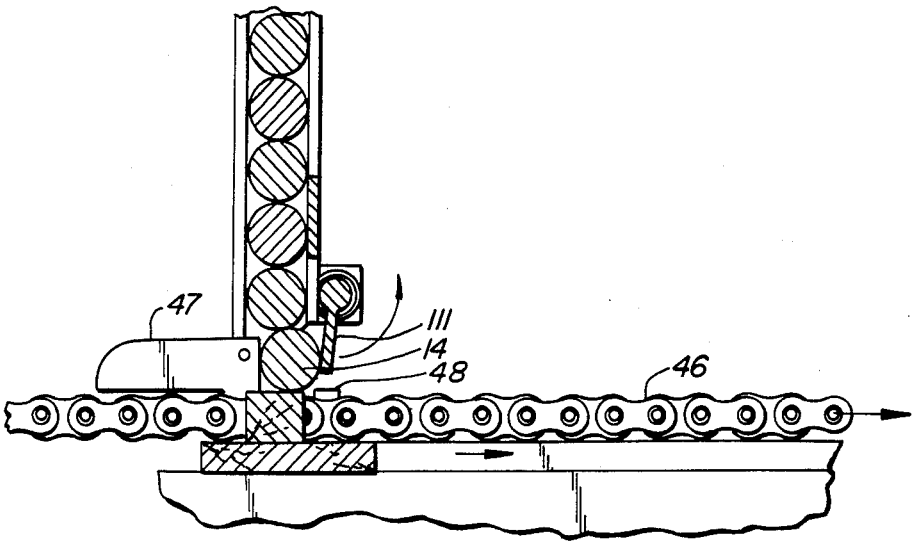
Figure 5D:
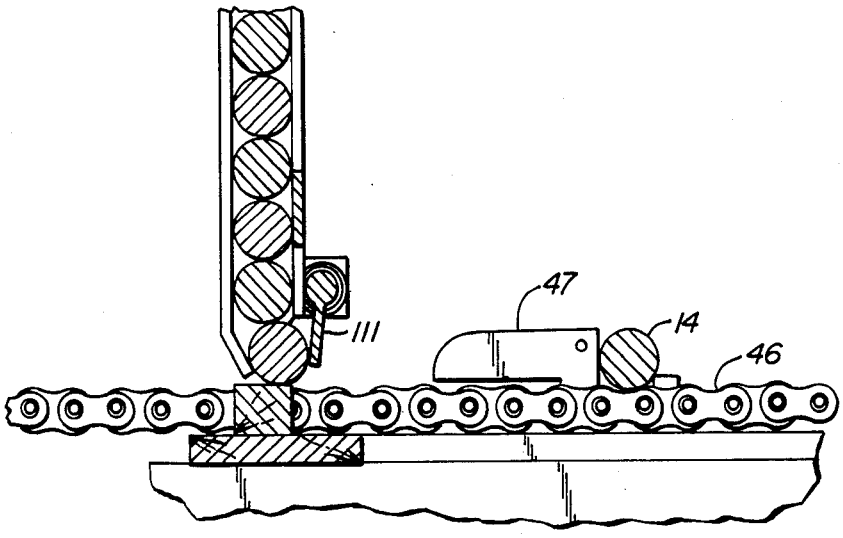

Referring to FIG. 5C, it can be seen that retainer bar 48 passes under the bars 14 and that pawl 47 dislodges the bars 14. This dislodgment occurs against the pivoting retainer bar 111. Finally, and in the sequence of FIG. 5D, it is seen that the chain 46 causes the bar 14 as followed by pawl 47 to be dispensed on the chain while the next in order dowel 14 is held in place by pivoting retainer bar 111. Thus, the sequence of dispensing of the bars can easily be understood.

Group Mounting of Inserters

The inserters A can take a number of different embodiments. Such a differing embodiment is illustrated in the view of FIG. 3.

Referring to FIG. 3, beam 63 has extended on either side thereof respective support beams 64, 65. Beam 63 and support beams 64, 65 correspond to support beam 24 of FIG. 1. Support beams 64, 65 in turn dependingly support a support plate 66. Support plate 66 is mounted from beams 64, 65 by a group of isolaters 67, there being approximately six isolaters 67 for the support of five inserters A. On either side of support plate 66 at preselected intervals there are fastened vibrators V. These vibrators may be hydraulic or electric. They are shown as electric and have an electric drive motor. They are Minnick "H1200" vibrators and are here shown in opposition one to another to impart the necessary vibrations to a group of inserters A's. As illustrated here, four such vibrators vibrate five inserters A.

The amount of vibrational energy communicated to the rod inserters is important. Specifically, and dependent upon the slump of the concrete, vibrational energy of varying amounts will be required. I have found for example that where the slump is low—in the range of $\frac{1}{4}$ inch to one inch, high vibrational energy is preferred. In this case, I use the inserter of FIG. 1. In this case, the vibrator is installed to each inserter. Such relatively low slump concrete is commonly used on airport runways and European highways.

Where, however, the slump is greater, as in the installation of domestic highways in the United States, lower vibrational energy can be used. In these embodiments, vibrators according to those illustrated in FIG. 3 can be used.

The reader will also understand that concrete is never constant in its constituent mix. Consequently, everything about concrete is variable. Precisely quantifying the amount of vibrational energy to liquefy the concrete is not practical or possible. Hence the vibrators utilized with the inserters of this invention should be variable in their energy output. They should always be able to supply sufficient energy to liquefy of the concrete as the dowels and inserters progress their way down through the slab to the point of rod insertion.

The construction of inserters A of FIG. 3 is similar to those of FIG. 1. Specifically, the inserters have magnetic portions 68 with an electromagnet E therebetween. Small stainless steel sections 69 at the top of magnetic portions 68 confine the magnetic path down the respective arms 68 and across any dowels 14 that are held by the unit. By the expedient of matching the interstitial spacing between the inserters A equivalent to the interstitial spacing between the dowels 14 disposed on the endless belt 46, it will be seen that a group of dowels may be picked up by an assembly of inserters A as illustrated in FIG. 3.

Having set forth the construction of the conveyor and the group of inserters, attention can now be directed to the process of insertion.

Process of Insertion

Figure 4A:
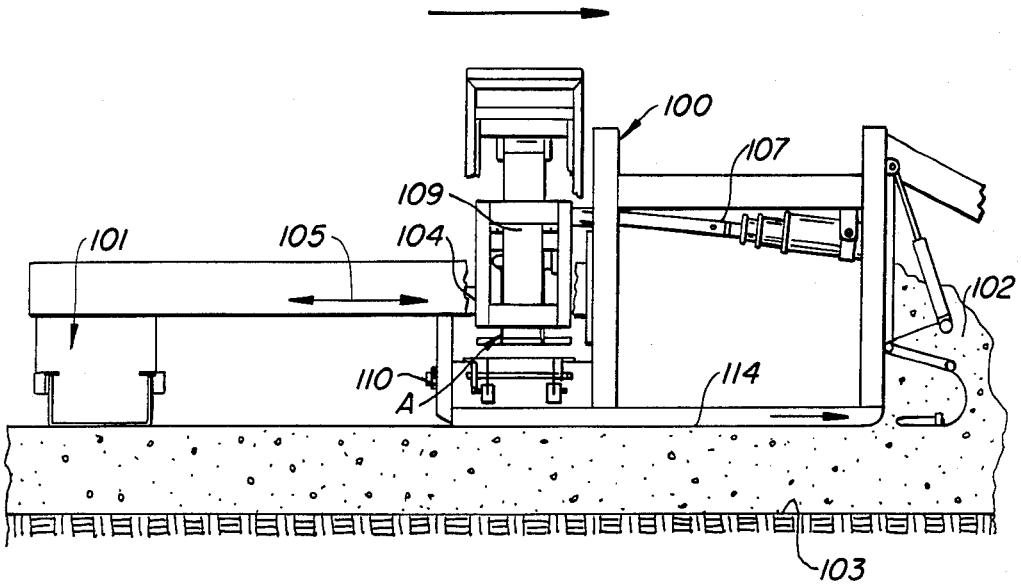
FIGS. 4A–4E are a cartoon series illustrating a slip form concrete paving machine operating in cycle with the dowel inserter of this invention.

Referring to FIG. 4A, a slip form paver 100 having an finishing beam 101 is shown progressively applying concrete 102 between a grade level 103 and the slipping form 104. As is common in the construction industry, the machine is furnished with means that give the slipping form 104 and all other portions of the machine a reference to grade and line.

It will be understood that the dowel inserting invention can be mounted to any number of mechanisms and that the invention is not confined to the slip form paver here illustrated. Indeed any machine which rides on rails over freshly poured and uncured concrete panels will supply a sufficient platform. It is necessary that the machine be provided with adequate reference to line and grade.

Continuing on with the views of FIGS. 3 and 4A, three mechanisms attached for the group of inserters A are necessary.

First, the group of inserters must be mounted to a frame mounted railway 105 at a moving car 104 (only shown schematically in FIG. 3). This enables the car 104 to slide back and forth overlying the concrete panels.

Secondly, some means for moving the car 104 on the railway must be present. Here, hydraulic cylinder 107 is utilized. Cylinder 107 causes the car to slide forwardly and backwardly.

Thirdly, some means of moving the group of inserters A into and out of the concrete pavement must be present. A cylinder 109 is here shown causing movement of the inserters A into and out of the pavement.

Movement occurs on a vertical railway 106 (see FIG. 3). Wire brush 110 is present. The wire brush causes the ends of inserters A to be cleaned immediately after retraction from the freshly poured concrete.

Setting forth the status of the machine cycle as shown in FIG. 4A can be instructive. Specifically, the endless belt 46 has disposed a group of rods 14 for pick-up. The electromagnetic across each of the inserters has been turned on and the inserters have come down on and over the respective dowels 14. At this particular time the vibrators are off. Dowels 14 have been slightly elevated by the inserters.

Referring to FIG. 2, and underlying each rod 14 as positioned on the conveyor, there will be seen to be resilient pads 38. It will be appreciated that hydraulic cylinders such as cylinders 109 typically have a slight overstroke. Once such an overstroke is present, tangs 30 must be able to grip their respective rods 14 and make the required magnetic connection without causing rod or conveyor breakage. Resilient pads 38 permit this overstroke to exist without causing machine failure.

Figure 4B:
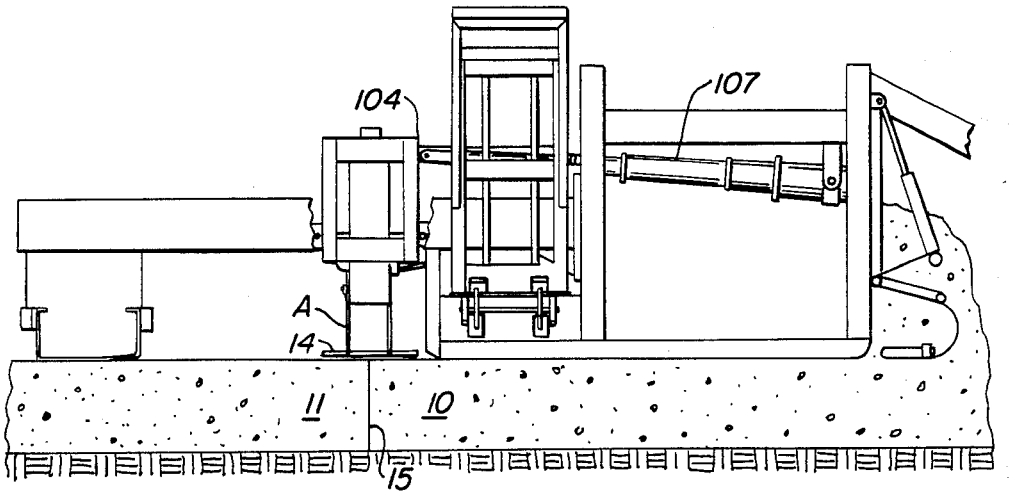

Referring to FIG. 4B, slabs 10, 11 are shown with an contraction joint area 15 therebetween. Hydraulic cylinder 107 has commenced to expand so as to maintain car 104 stationary over the contraction joint area 15 between slabs 10, 11, it being realized that the contraction joint will not be installed until after the rods are inserted. The dowels 14 are held by the inserter A immediately over the joint area 15. Note that at this juncture, it is possible for observation of the dowels relative to the joint area 15 to occur.

Figure 4C:
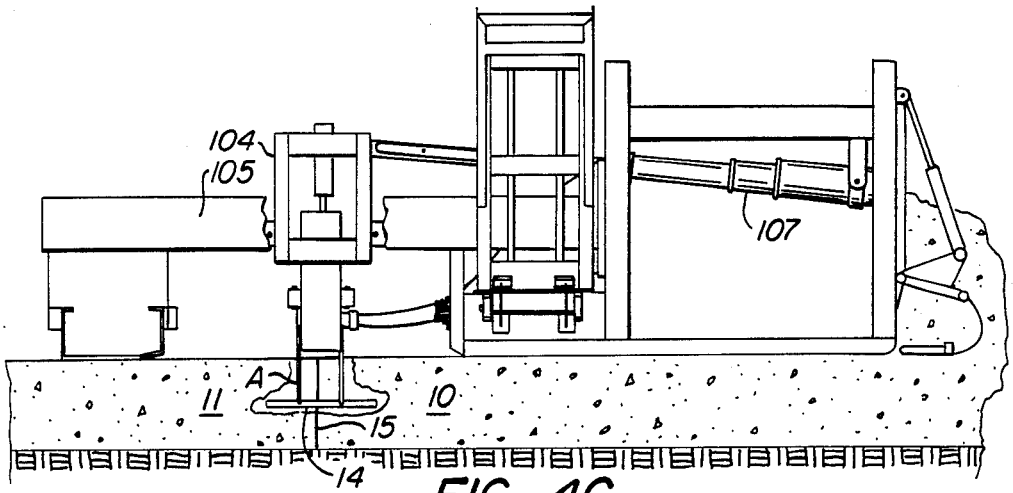

Referring to FIG. 4C, the inserters A will have lowered the dowels 14 across the intended joint 15 between slabs 10, 11. The magnets E will remain on and the vibrator V will be turned on immediately before insertion commences. Typically, the three stage cylinder 107 is released and the carriage allowed to freely wheel along the railway 105 so that there is no relative movement between the group of inserters A and the passing concrete slabs 10, 11.

It is important to note that the vibrational energy imparted has the effect of fluidizing the concrete. Specifically, the concrete is fluidized in and around the rod 14 and the inserter A. Thus the dowel freely passes into and through the freshly poured concrete slab along a full fluidized path. The respective solid and fluid areas are denominated on the drawing by a wavy line surrounding inserter A and are only illustrative of the state of the slab when dowel 14 has arrived at its full depth of penetration.

Insertion in actual practice occurs to a depth as required by specification for a particular job. By way of example insertion could be approximately half of the slab width, in the illustrated case in the order of five inches of a ten inch slab.

It is an important aspect of this invention that the disclosed vibrations do not interfere with the slab. In fact, the apparatus and process leaves the surface of the slab substantially undisturbed and does not effect or segregate either the aggregate, cement or sand constituents of the concrete.

Figure 4D:
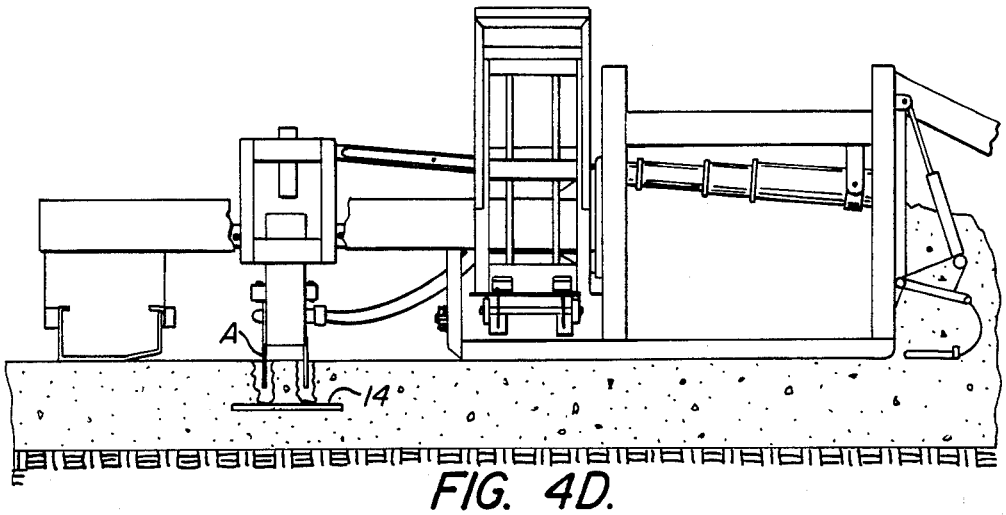
Figure 4E:
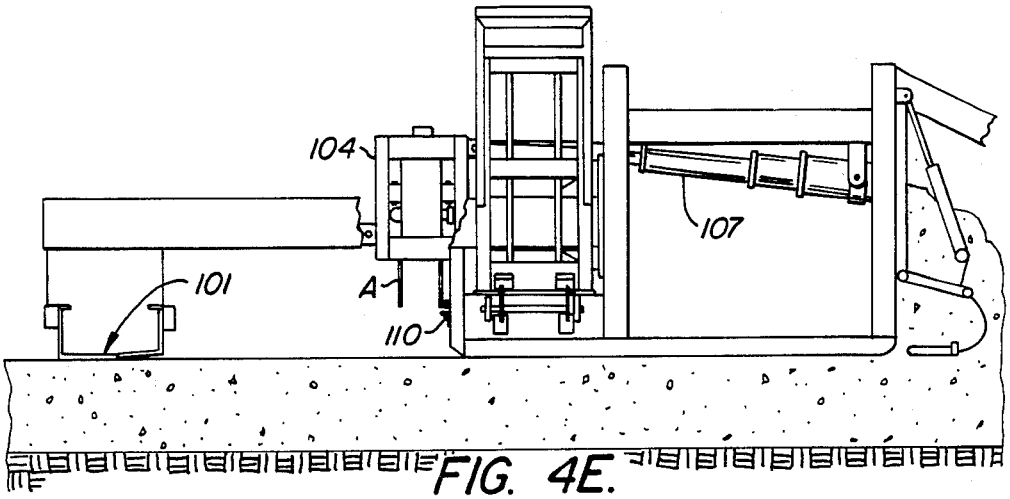

Referring to FIG. 4D, retraction of the inserters A is illustrated. In the sequence, the dowels 14 are placed. The magnet is turned off and the retractors moved a small distance. Thereafter when the tangs of the retractors clear the dowels, the vibrators are restarted.

It is at this juncture that the process has some rather subtle features. Once vibration is ceased and the dowel 14 released, what was a relatively fluidized concrete mixture becomes immediately solidified. The dowel 14 is captured by the concrete mass in precisely the alignment it had when the vibration ceased. Naturally and when the electromagnetic force which maintains the dowel to the inserter is turned off, retraction of the inserter A leaves the dowel 14 firmly and accurately embedded within the concrete.

It is to be noted over the prior art chair mechanism that it is the dowel that is inserted to the preexisting slab of concrete. It is not the concrete being poured around the dowel. There results a dowel 14 which can only be maintained in the concrete in the disposition it was placed.

Further, and after the inserters A have cleared the dowel 14 by even a small distance, vibration is recommenced. At this juncture, the inserter A fluidizes the concrete about its respective arms. The concrete therefore flows and occupies the volume occupied by the inserter as it is withdrawn. In short, fluidized concrete fills into the path of the withdrawn inserter.

Referring to FIG. 4F, cylinder 107 is shown with drawing carriage 104 and inserters A over the wire brush 110. Wire brush 110 cleans the bottom of the inserters of any cement or grout that may remain thereon and enables a clean metal-to-metal contact to occur when the next rods are picked up. At the same time, the oscillating finishing beam 101 finishes over the surface of the concrete. Any blemish left in the slab by the withdrawal of the inserters A is avoided.

It is preferred to leave the vibrators on during the wire brushing of the concrete. It will be remembered that the vibrators function to fluidize the concrete. Concrete on the bottom of the tangs 30 will be fluidized also. In the fluidized states, the wire brushing has the maximum cleaning effect.

After the tangs have been wire-brushed, the vibrators and the electromagnets are both off. The sequence is then restarted.

It will be apparent having skill in the arts that this invention will admit of a number of modifications. Morover, the precise sequence of electromagnetic controls and the like are believed to be well within the skill of those ordinarily acquainted with the art.

What is claimed is:

1. Apparatus for inserting a dowel at an intended joint in a freshly placed concrete slab comprising:

a support member;

first and second dowel arms secured to and vertically depending from said support member, a lower portion of each of said dowel arms having the property of conducting a magnetic field, said dowel arms having lower ends configured to engage the dowel;

means, mounted between said lower portions of said dowel arms at a point spaced apart from said lower ends, for applying a magnetic field to said lower portions to retain a dowel to said lower ends of said dowel arms;

means for inserting said dowel arms and the dowel retained by said dowel arms therewith into the freshly placed concrete slab; and means for vibrating said dowel arms and the retained dowel therewith during their insertion into the freshly placed concrete slab, said vibrating means arranged and adapted to fluidize said freshly placed concrete during the insertion.

2. The apparatus of claim 1 wherein said magnetic field applying means includes an electromagnet mounted between said first and second dowel arms.

3. The apparatus of claim 1 further comprising vibration isolation means for vibrationally isolating said vibrating means from said inserting means.

4. The apparatus of claim 3 wherein said inserting means includes a support beam and said vibrationally isolating means includes a plurality of shock isolators mounted between said support beam and said support member.

5. The apparatus of claim 1 wherein said vibrating means is mounted to said support member.

6. The apparatus of claim 1 wherein said first and second dowel arms include upper portions of non-magnetic material to concentrate the magnetic field within said lower dowel arm portions to enhance the magnetic attraction between the dowel arms and the dowel.

7. The apparatus of claim 1 wherein said lower ends of said dowel arms have dowel receiving concavities formed therein.

8. The apparatus of claim 1 wherein said lower ends of said dowel arms are configured for complementary mating engagement with the dowel.

9. The appartus of claim 8 wherein said lower ends have an arcuate contour.

10. The apparatus of claim 1 further comprising a plurality of pairs of said first and second dowel arms mounted to said support member.

11. Apparatus, mounted to and adapted for use with a concrete paving machine, for inserting a plurality of dowels at spaced apart points along an intended joint in a freshly placed concrete slab, the apparatus comprising:

a dowel magazine assembly mounted to the paving machine comprising:

a dowel magazine adapted to house a plurality of dowels and serially present the dowels at a dowel pick up point;

a dowel conveyor arranged and adapted to serially strip the dowels from the dowel pick up point and load the dowels on the conveyor at predetermined intervals; and means for stopping the dowel conveyor when a predetermined number of dowels have been loaded on said dowel conveyor; and a dowel insertion assembly mounted to the paving machine comprising:

a support member;

a plurality of sets of first and second dowel arms dependingly mounted to said support member at said predetermined intervals, a lower portion of each of said dowel arms having the property of conducting a magnetic field, said dowel arms having lower ends configured to engage the dowels;

means for movably transporting said support member and said dowel arms therewith between a first position at said dowel conveyor and a second position spaced apart from said dowel conveyor;

means, mounted between said lower portions of said sets of dowel arms at points spaced apart from said lower ends, for applying a magnetic field to said lower portions to secure dowels to said lower ends of said sets of dowel arms;

means for inserting said sets of dowel arms and the dowels secured to said sets of dowel arms into the freshly placed concrete slab; and means for vibrating said sets of dowel arms and the dowels secured thereto during their insertion into the freshly placed concrete slab, said vibrating means arranged and adapted to fluidize said freshly placed concrete during said insertion.

12. The dowel support apparatus of claim 11 further comprising means for cleaning the lower ends of said sets of dowel arms.

13. Apparatus, mounted to and adapted for use with a concrete paving machine, for inserting a plurality of dowels at spaced apart points along an intended joint in a freshly placed concrete slab, the apparatus comprising:

means, mounted to the paving machine, for providing dowels at a dowel pick-up location;

a support member mounted to the paving machine;

first and second dowel arms secured to and vertically depending from said support member;

means for releasably securing a dowel to said lower ends of said dowel arms;

means for inserting said dowel arms, and the dowel secured to said dowel arms therewith, into the freshly placed concrete slab and for withdrawing said dowel arms from the concrete slab thereafter;

means for vibrating said dowel arms, and the dowel secured thereto, during their insertion into the freshly placed concrete slab, said vibrating means arranged and adapted to fluidize said freshly placed concrete during the insertion; and means for cleaning concrete from the lower ends of said dowel arms.

14. The apparatus of claim 13 wherein said releasably securing means includes an electromagnet mounted between said dowel arms.

15. A process for inserting a dowel at an intended joint of a freshly poured concrete slab comprising the following steps:

magnetically grasping the dowel at the lower ends of first and second spaced apart dowel arms;

positioning the dowel arms and dowel therewith over the intended joint of the freshly poured concrete slab;

inserting said dowel arms and dowel therewith into the concrete slab along a generally vertical path;

releasing the dowel while inserted within the concrete slab;

withdrawing the dowel arms from the concrete slab; and vibrating said dowel arms and dowel therewith during at least a substantial portion of said inserting step.

16. The process of claim 15 further comprising the step of cleaning the lower ends of the first and second dowel arms following the withdrawing step.

* * * * *